US005535562A

United States Patent [19]

Huang et al.

[11] Patent Number: 5,535,562

[45] Date of Patent: Jul. 16, 1996

[54] SADDLE ANCHORAGE AND MOUNTING METHOD THEREOF

[76] Inventors: Chia-Hsiung Huang, 3 Fl. No. 22, Lane 89, Ku-King Street, Taipei; John Chiang, No. 21, Lane 22, Hsin-Min Road, Taipei, both of Taiwan

[21] Appl. No.: 498,567

[22] Filed: Jul. 6, 1995

[30] Foreign Application Priority Data

Sep. 23, 1994 [CN] China ..... 94 1 15365.7

[51] Int. Cl.[6] ..... E04C 5/12

[52] U.S. Cl. ..... 52/223.13; 52/223.1; 52/223.8; 52/745.21; 24/136 R; 24/115 M; 24/122.6

[58] Field of Search ..... 52/223.1, 223.6, 52/223.13, 223.8; 49/122.6, 136 R, 115 M

[56] References Cited

U.S. PATENT DOCUMENTS

| | | | |
|---|---|---|---|
| 3,251,162 | 5/1966 | Strimple | 52/223.8 |
| 3,505,824 | 4/1970 | White | 52/223.1 X |
| 4,680,906 | 7/1987 | Prevedini | 52/223.13 |
| 5,175,968 | 1/1993 | Saucke | 52/223.8 |
| 5,325,746 | 7/1994 | Anderson | 24/115 M X |

FOREIGN PATENT DOCUMENTS

| | | | |
|---|---|---|---|
| 2545130 | 11/1984 | France | 52/223.13 |

*Primary Examiner*—Carl D. Friedman
*Assistant Examiner*—Winnie Yip
*Attorney, Agent, or Firm*—Helfgott & Karas

[57] ABSTRACT

A saddle anchorage in which the direction of the prestress is not perpendicular to the compression surface of the concrete structure. The anchorage comprises a saddle including a rectangular metal plate provided with two parallel locking portions defining a hollow portion therebetween, a bottom portion for the hollow portion, a first rib plate, a second rib plate, a third rib plate having a first opening, a hollow cylindrical sleeve, a plurality of U-shaped first reinforcing steel bars, and a plurality of U-shaped second reinforcing steel bars; and a rider for fixing an anchor head including two triangular side plates provided with locking portions, a rectangular top plate, and a front plate having a second opening.

A method of mounting the anchorage according to the present invention comprising of directly mounting the saddle into a suitable space in a reinforcing cage of a web; mounting the rider onto the saddle through the engagement of respective locking portions; and fixing an anchor head in the second opening provided on the front plate of the rider.

6 Claims, 6 Drawing Sheets

SADDLE ANCHORAGE AND MOUNTING METHOD THEREOF

BACKGROUND OF THE INVENTION

1. Field of the Invention

The present invention relates to a saddle anchorage in which the direction of the prestress is not perpendicular to the compression surface of the concrete structure, and a mounting method thereof.

2. Description of the Prior Art

Ever since the prestressed concrete engineering was put into practice in 1940, post-tensioning tendons have been utilized in the interior of the walls of many large prestressed concrete structures, such as bridges, oil tanks, cement silos, and grain silos, to support the dead loads thereof and other loads. After the prestressed concrete structure is built, the action forces, e.g. external loads, live loads, and temperature variation actions, are mainly supported by such post-tensioned tendons.

In general, the stressing end anchorage of tendons is mounted onto the end surface of the wall of the structure. However, under many circumstances, the stressing end anchorage has to be mounted onto a side wall (a web) or a bottom wall (a slab) of the structure. In these cases, it is necessary to further construct a plurality of concrete buttresses projecting from the web or the slab of the structure to carry these stressing end anchorages. For example, when tendons are installed in the interior of the web of a cylindrical structure, such as an oil tank, a cement silo, or a grain silo, to provide a circumferential prestress, it is necessary to construct a plurality of triangular conical or rectangular concrete buttresses onto the web of the structure to carry the stressing end anchorages. Also, as shown in FIG. 1, when the free cantilever method is used to construct a bridge, it is necessary to install post-tensioning tendons in the top and bottom parts of the box girders to support different loads. Here, tendons H (post-tensioning tendons for negative moments) are installed in the webs of the box girders to undertake the negative moments created by the dead loads of the box girders and other loads when the working wagon moves outwards from the pier during construction, while tendons L (post-tensioning tendons for positive moments) are installed in the webs or the slabs at the outside end of the end span and at the middle span to undertake the positive moments created by part of the dead loads of the box girders and other loads when the box girders are closed to complete the bridge construction. Since tendons H are anchored on the outwardly facing end surfaces of the webs of new segments, the mounting of the stressing end anchorages is straightforward and relatively easy. However, since tendons L are anchored on the side surfaces of the webs of the box girders, it is necessary to construct a plurality of triangular conical concrete buttresses onto the side surfaces of the webs to carry these stressing end anchorages.

The inventors have worked in the field of the prestressing concrete engineering for more than ten years, and have been involved in the circumferential prestressing of cylindrical structures and the construction of bridges using the free cantilever method. The inventors have encountered the undesirable time and labor consuming in further constructing the triangular conical buttress to carry the stressing end anchorage on the side surface of the web. As shown in FIG. 2, in the conventional method of constructing the triangular conical buttress, a triangular conical reinforcing cage T which protrudes gradually along the longitudinal direction of the web W is set up by tying steel bars to the ones of the web W. After a sheath P for strands, an anchor body EA connected to the end of the sheath P, and a spiral reinforcement EP (to resist the tensile stress) wrapped around the outer circumference of the anchor body EA are buried into the interior of the triangular conical reinforcing cage T, a triangular conical formwork (not shown) is constructed around the triangular conical reinforcing cage T. Then, concrete is cast into the formwork. After the concrete is cured to form the desired triangular conical buttress B, steel tendons (not shown) are inserted into the sheath P and post-tensioned, and the post-tensioned ends are fixed afterwards to the anchor body EA.

From previous experiences, it is known that, when a bridge is constructed by the free cantilever method, an additional time of 1 to 2 working days is needed to construct a triangular conical buttress B on the side surface of the web of the box girder. This is because that, in order to construct the triangular conical reinforcing cage T which protrudes gradually along the longitudinal direction of the web W of the box girder, it is necessary to tie a plurality of steel bars Tt bent into a ⌈1 shape and a plurality of straight steel bars Tx different in length with one another. However, since the steel bars Tt and Tx are to be tied at different locations on the reinforcing cage T, their lengths and bending positions are different from one another. Hence, these steel bars Tt and Tx can not be mass-produced in standardized dimensions. Each time a reinforcing cage is needed, steel bars are cut and bent into segments of desired lengths and shapes, which is a very troublesome work, and the tying of the steel bars to construct the triangular conical reinforcing cage and to mount the cage onto the side surface of the web requires skilled workers. Furthermore, to set up the triangular conical formwork around the triangular conical reinforcing cage is time consuming and usually wastes a considerable amount of forms. Finally, to form a triangular conical buttress B, an extra 1 to 2 cubic meters of concrete is needed, making it uneconomical.

In view of the various problems presented in the prior art, the present invention provides a saddle anchorage which is manufactured in the factory before taken to the construction site and can be mounted directly onto a side surface of a web or a slab of a prestressed concrete structure, and a mounting method of the saddle anchorage, thereby eliminating the on-site tying of a reinforcing cage, reducing the amount of wasted concrete and forms, and solving other problems of prior art.

SUMMARY OF THE INVENTION

To achieve the above objects, the present invention provides a saddle anchorage consisting of a saddle and a rider for fixing an anchor head. The main body of the saddle is a rectangular metal plate. A first locking portion and a second locking portion are formed substantially in parallel with each other along the longitudinal direction of the metal plate on an exposed surface near the front end side thereof. The portion of the metal plate between the two locking portions is cut away to form a hollow portion therebetween. A part of a truncated hollow cone, obtained by cutting the cone obliquely, is integrally connected to the underside of the metal plate to form a bottom portion of the hollow portion. A first rib plate is integrally and obliquely connected to the underside of the front end edge of the metal plate. A second rib plate is integrally and obliquely connected to the underside of the truncated hollow cone at substantially the middle thereof. A third rib plate provided with a first opening for tendons is integrally and obliquely connected to the underside of the metal plate at the rear end of the truncated hollow cone to form an end plate thereof. A hollow cylindrical sleeve for inserting a sheath for tendons is integrally connected to the back side of the third rib plate with the hole of the sleeve aligned to the first opening. A plurality of U-shaped first reinforcing steel bars are connected along two longitudinal sides of the metal plate in such a manner that each bar extends downwards obliquely from the metal plate at a predetermined angle with respect to the metal plate. Further, a plurality of U-shaped second reinforcing steel bars are connected to a predetermined area on the underside of the rear end side of the metal plate in such a manner that each bar extends outwards from and substantially perpendicular to the underside of the metal plate.

The rider for fixing an anchor head is a triangular conical hollow cap comprising a first and a second triangular side plates, a rectangular top plate, and a substantially square front plate integrally connected together. A third and a fourth locking portions engageable respectively with the first and the second locking portions of the saddle are formed on the lower edges of the first and the second side plates respectively. The lower edge of the front plate extends downwards beyond the third and the fourth locking portions to bear against the front end edge of the saddle when the rider is mounted thereon. The front plate is provided with a second opening for fixing an anchor head.

The method of mounting the saddle anchorage according to the present invention onto a side surface of a web or a slab of a prestressed concrete structure comprises the following steps. After a reinforcing cage of the web or the slab of the prestressed concrete structure is set up, a reinforcement part where the saddle of the anchorage according the present invention is to be mounted is dismantled to provide a desired space. The saddle of the anchorage according to the present invention is then mounted into the space and tied or welded to the reinforcing cage of the web (or the slab). Additional reinforcing steel bars are provided to increase strength. After a formwork is construct around the reinforcing cage of the web (or the slab), concrete is cast thereinto. After the concrete is cured, the formwork is removed, and post-tensioning tendons are inserted through the first opening and the sleeve of the saddle into a sheath for tendons which is already buried in the interior of the web (or the slab). The rider is then mounted onto the saddle in such a manner that the third and fourth locking portions of the rider engage with the first and second locking portions of the saddle respectively, and the lower edge of the front plate of the rider bears against the front edge of the saddle. Finally, an anchor head is fixed in the second opening of the front plate of the rider and a post-tensioning procedure can be started.

With the saddle anchorage consisting of the saddle and the rider according to the present invention, the saddle can be readily mounted and fixed onto the reinforcing cage of the web (or the slab) of the prestressed concrete structure, and the rib plates and the first and second reinforcing steel bars provided under the saddle serve to prevent the saddle from sliding upon the grouting of the concrete and as part of the reinforcing cage of the web (or the slab) of the prestressed concrete structure, thereby enhancing the strength and crack resistance. Moreover, the rider can be mounted onto the saddle easily and quickly by engaging their locking portions with each other.

Furthermore, the saddle and the rider of the saddle anchorage according to the present invention can be mass-produced in factory before taken to the construction site for installation, thereby eliminating the troublesome on-site construction of the additional triangular conical reinforcing cage and the formwork. Therefore, the efficiency of mounting the anchorage on the side surface of the web (or the slab) of the prestressed concrete structure is greatly improved and the working time thereof is shortened, even when the mounting work is handled by inexperienced workers. In addition, since the tensile strength and the compressive strength of steel are much higher than those of concrete, the anchorage made of steel according to the present invention is superior in strength to the concrete buttress according to prior art.

BRIEF DESCRIPTION OF THE DRAWINGS

The above and other objects, features and advantages of the present invention will become apparent from the following description of the preferred embodiment of the invention considered in connection with the the accompanying drawings, in which.

DETAILED DESCRIPTION OF THE PREFERRED EMBODIMENT

A preferred embodiment of the present invention will be described in detail in the following with reference to the accompanying drawings.

Figure 1:
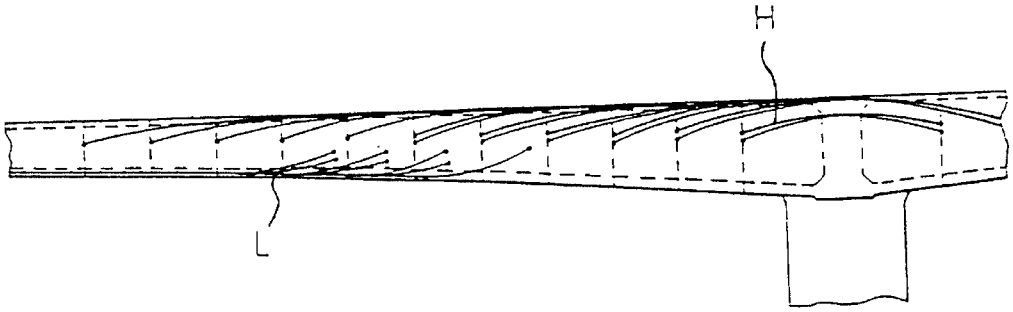
FIG. 1 is a schematic view showing an arrangement of tendons in a bridge constructed by the free cantilever method.
Figure 2:
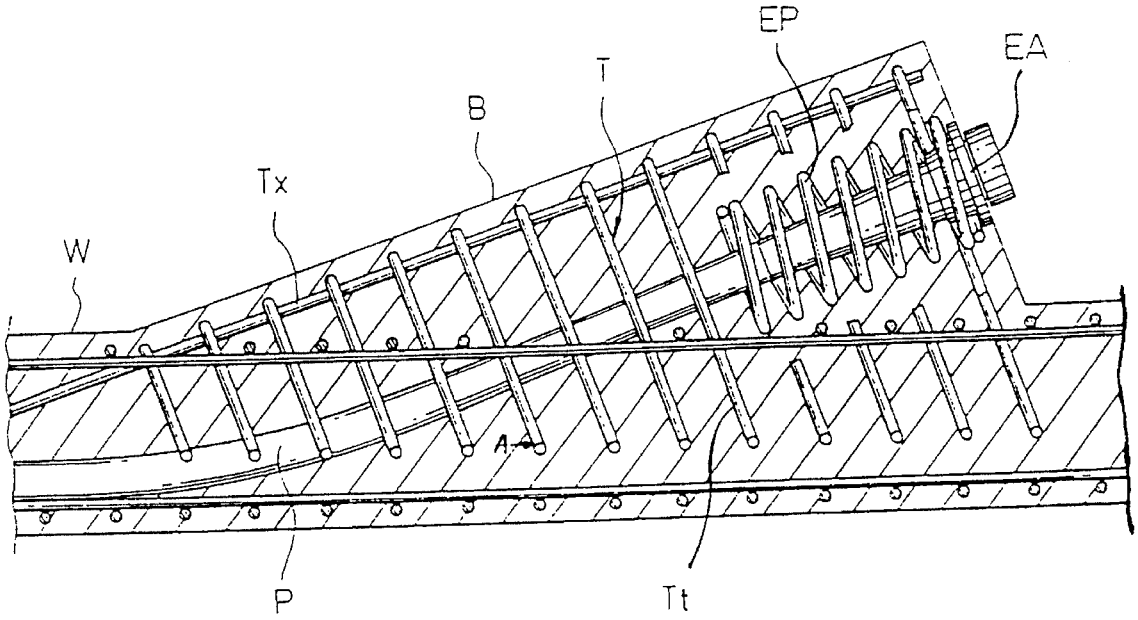
PRIOR ART Fig. 2
FIG. 2 is a longitudinal sectional view showing a concrete buttress constructed onto a side surface of a web according to the prior art.
Figure 3:
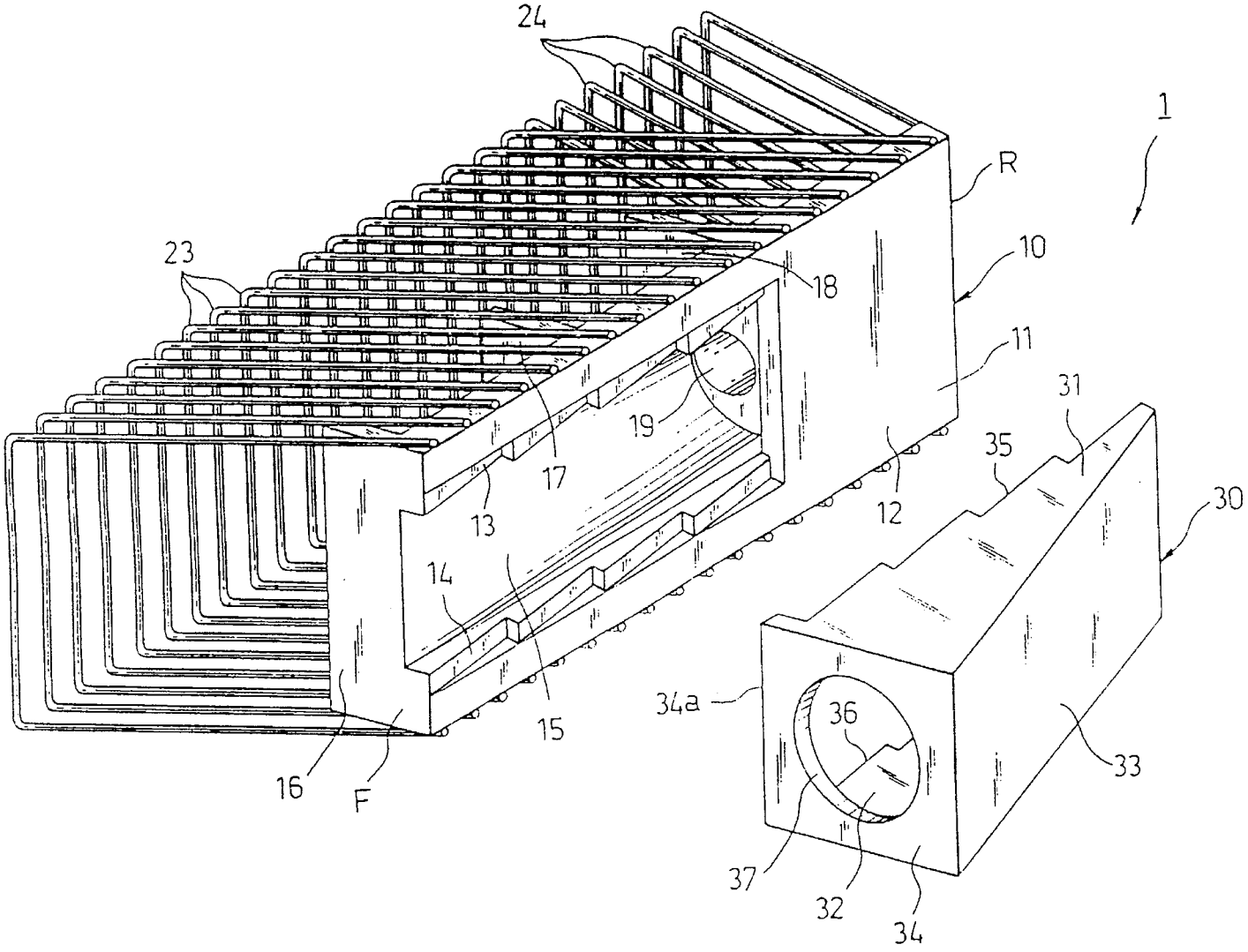
FIG. 3 is a perspective view showing a saddle and a rider of a saddle anchorage according to the present invention in an unassembled state.
Figure 4:
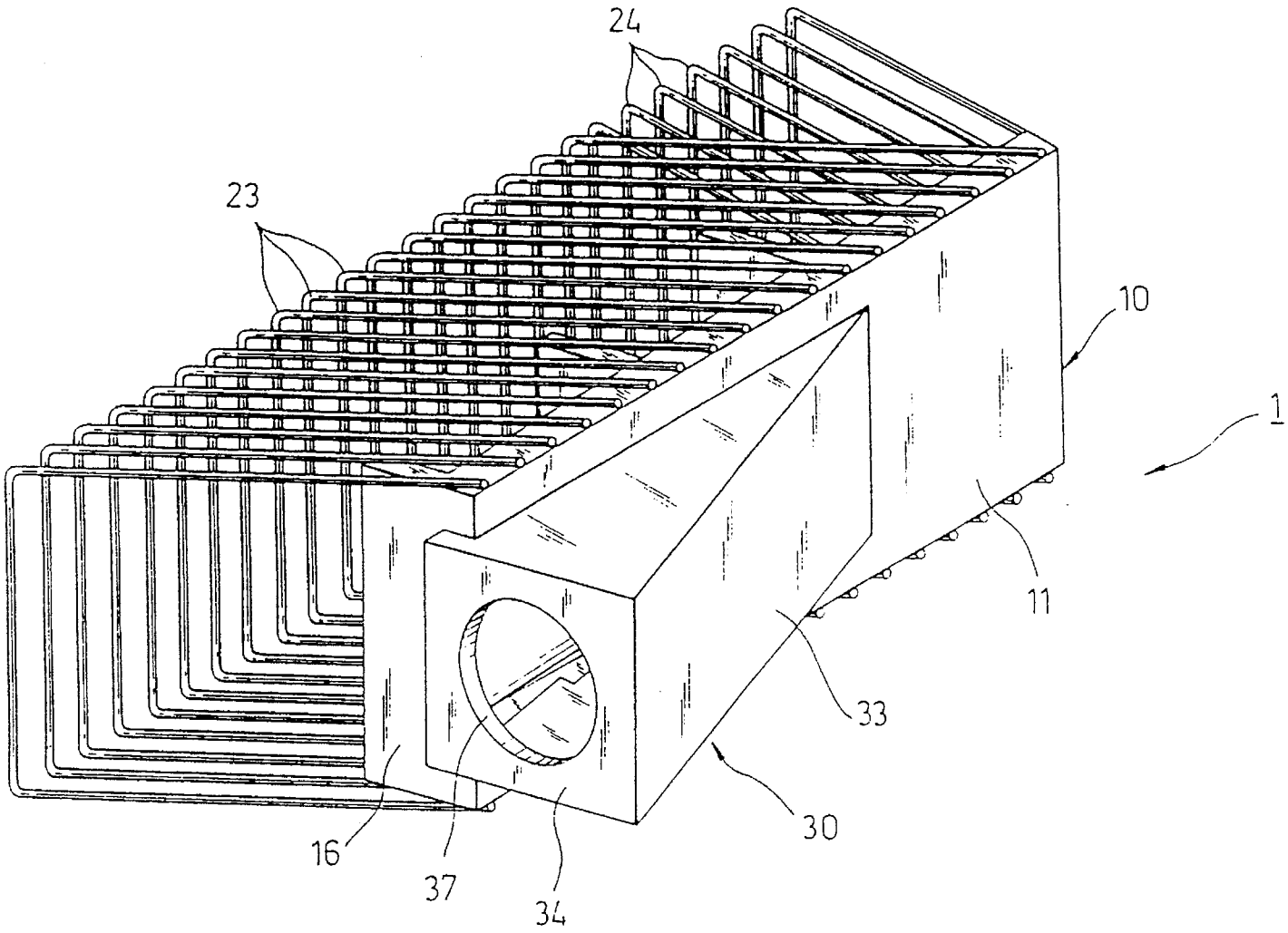
FIG. 4 is a perspective view showing the assembled saddle anchorage of FIG. 3.

Referring to FIGS. 3 and 4, a saddle anchorage 1 according to a preferred embodiment of the present invention consists of two main parts, a saddle 10 which is to be mounted and fixed onto a reinforcing cage of a web (or a slab) of a prestressed concrete structure, and a rider 30 which is to be mounted onto the saddle 10 for fixing an anchor head. FIG. 3 shows the two main parts in a separated state, while FIG. 4 shows their assembled state.

Figure 5:
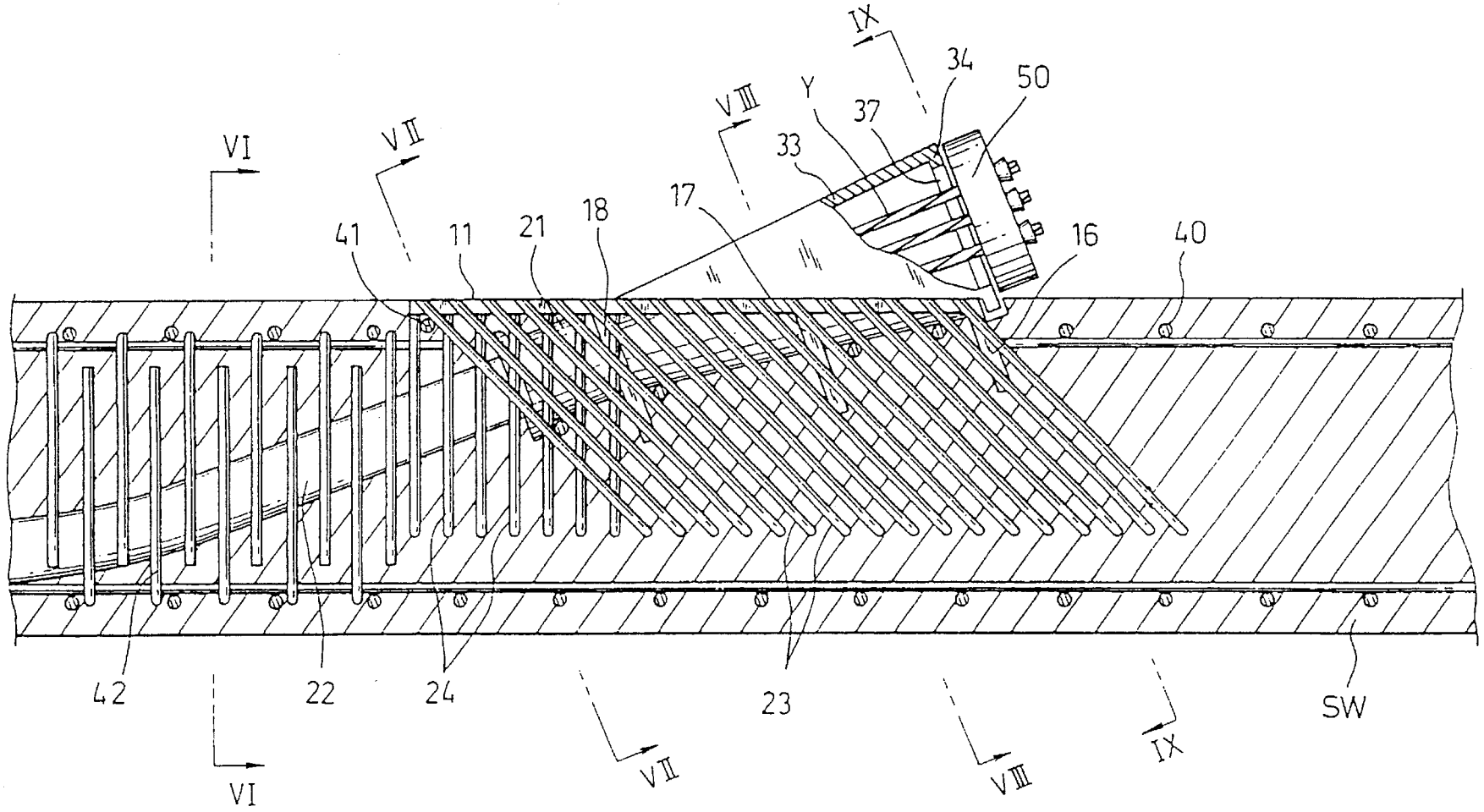
FIG. 5 is a longitudinal sectional view showing the saddle anchorage of FIG. 3 mounted onto a side surface of a web.

The main body of the saddle 10 is a rectangular plate 11 made of metallic material such as steel. A first locking portion 13 and a second locking portion 14 in a stepped structure are formed in parallel with each other along the longitudinal direction of the metal plate 11 on an exposed surface 12 (the surface exposed after the saddle 10 is fixed in place) near the front end side (F side in the drawing) thereof. The portion of the plate 11 between the two locking portions 13 and 14 is cut away to form a hollow portion therebetween. A part of a truncated hollow cone made of steel, obtained by cutting the cone obliquely, is welded to the underside of the metal plate 11 to form a bottom portion 15 of the hollow portion between the first locking portion 13 and the second locking portion 14. As shown in FIG. 5, the bottom portion 15 tapers gradually inwards from the front end (right-hand side in FIG. 5) of the metal plate 11 to the rear end (left-hand side in FIG. 5) of the metal plate 11 in the form of a hollow cone.

A rectangular first rib plate 16 made of steel is welded to the underside of the front end edge (F side in FIG. 3) of the metal plate 11. As shown in FIG. 5, the first rib plate 16 is obliquely connected to the underside of the metal plate 11. A second rib plate 17 made of steel is welded to the underside of the bottom portion 15 at substantially the middle thereof. As shown in FIG. 5, the second rib plate 17 is also obliquely connected to the underside of the bottom portion 15. A rectangular third rib plate 18 made of steel is welded to the underside of the metal plate 11 at the rear end of the bottom portion 15. In this way, the third rib plate 18 serves as an end plate of the bottom portion 15. In addition, the third rib plate 18 is provided with a first opening 19 for passing post-tensioning steel strands Y as shown in FIG. 5. The third rib plate 18 is also obliquely connected to the underside of the metal plate 11. The first, second, and third rib plates 16, 17, and 18 are substantially parallel to one another, and serve to prevent the saddle 10 from sliding.

Figure 7:
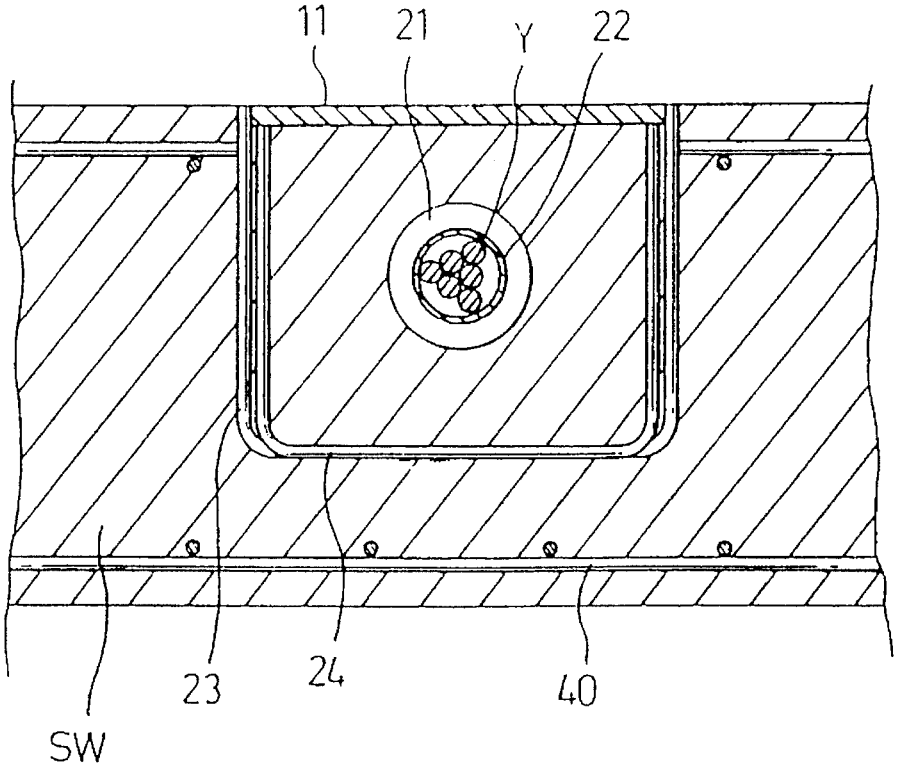
FIG. 7 is a sectional view along the line VII—VII of FIG. 5.
Figure 8:
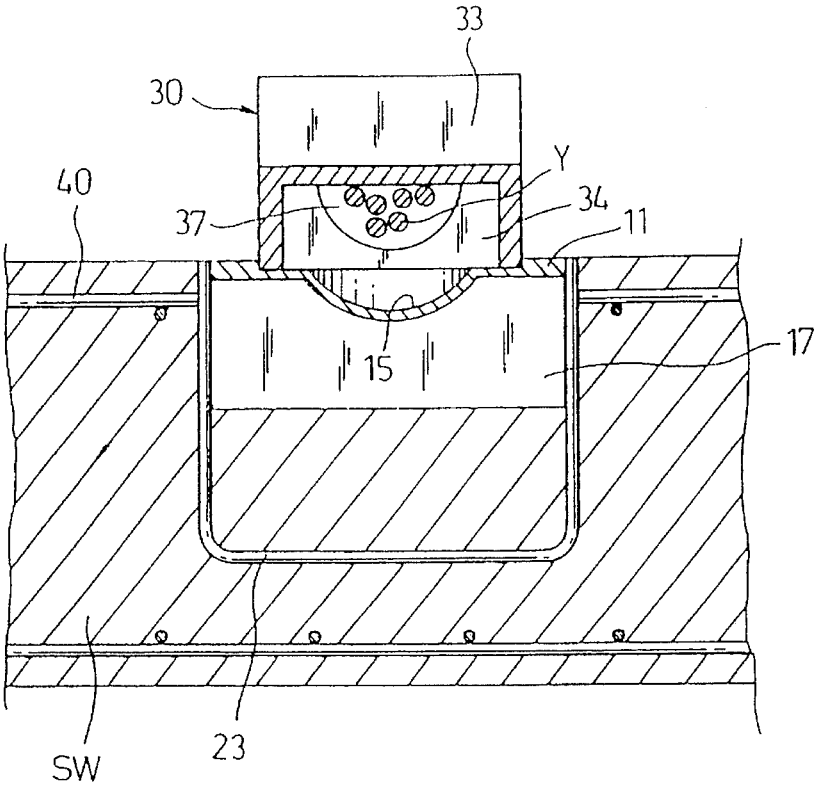
FIG. 8 is a sectional view along the line VIII—VIII of FIG. 5.
Figure 9:
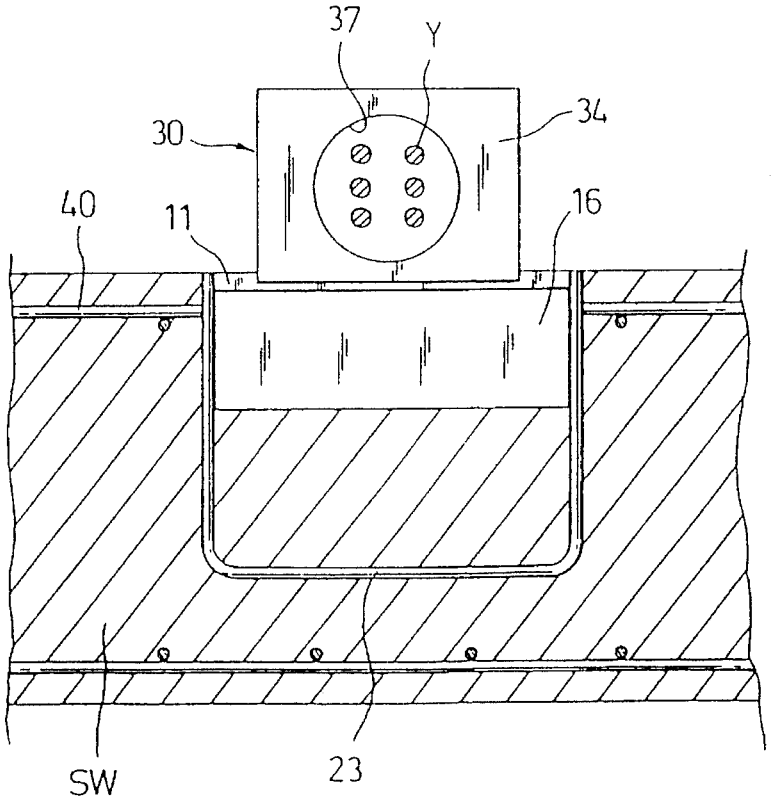
FIG. 9 is a sectional view along the line IX—IX of FIG. 5.

Furthermore, as shown in FIG. 5, a hollow cylindrical sleeve 21 made of steel is welded to the third fib plate 18 on the side near the rear end side (R side in FIG. 3) of the metal plate 11 with the hole of the sleeve 21 aligned to the first opening 19. A sheath 22 for post-tensioning strands, which is buried in advance inside the web SW of the concrete structure, is inserted into the sleeve 21 for connection (see FIG. 7).

As shown in FIGS. 3 to 5, a plurality of first reinforcing steel bars 23 substantially in a U shape are welded along two longitudinal sides of the metal plate 11. Each of the first reinforcing steel bars 23 is arranged to extend downwards obliquely from the metal plate 11 toward the front end thereof at a predetermined angle with respect to the metal plate 11. The predetermined angle is suitably selected in the range from 40 to 50 degrees depending on the thickness of the web SW of the concrete structure. The first reinforcing steel bars 23 serve to replace part of the reinforcing cage of the web SW to increase the strength and to prevent the web from cracking. The number of the reinforcing steel bars 23 and the interval between two adjacent reinforcing steel bars 23 are suitably selected based on the thickness of the web SW of the concrete construction.

Moreover, a plurality of U-shaped second reinforcing steel bars 24 are welded to a predetermined area on the underside of the rear end side (left-hand side in FIG. 5) of the metal plate 11, i.e., the area between the rear end of the metal plate 11 and the third rib plate 18. Each of the second reinforcing steel bars 24 is arranged to extend downwards from and substantially perpendicular to the underside of metal plate 11. The second reinforcing steel bars 24 also serve to replace part of the reinforcing cage of the web SW to increase the strength and to prevent the web from cracking. The number of the reinforcing steel bars 24 and the interval between two adjacent reinforcing steel bars 24 are also suitably selected based on the thickness of the web SW of the concrete construction.

As shown in FIG. 5, the rider 30 for fixing an anchor head is in the form of a hollow triangular conical cap consisting of a first and a second triangular side plates 31 and 32, a rectangular top plate 33, and a substantially square front plate 34, all made of steel and connected by welding. A third and a fourth locking portions 35 and 36 engageable respectively with the first and second locking portions 13 and 14 of the saddle 10 are formed on lower edges of the first and the second side plates 31 and 32 respectively. The lower edge **34*a* of the front plate 34 extends downwards beyond the third and fourth locking portions 35 and 36 such that when the rider 30 is mounted onto the saddle 10, the lower edge 34*a* of the front plate 34 can bear against the front end edge of the saddle 10. The front plate 34 is provided with a second opening 37 for fixing an anchor head 50**.

It should be understood that, although in this embodiment the first and the second locking portions 13 and 14 of the saddle 10 and the third and the fourth locking portions 35 and 36 of the rider 30 are made in the form of steps engageable with each other, the structure of the locking portions is not limited thereto. For example, a serrated structure may be used instead to achieve the effect of engagement.

It should also be understood that, although the metal plate 11, the bottom portion 15, the first rib plate 16, the second rib plate 17, the third rib plate 18, and the sleeve 21, all made of steel, are connected together by welding to constitute the major part of the saddle 10, casting may be used instead to integrally form the saddle 10 (without the reinforcing steels bars 23, 24) as one piece. Casting is suitable for mass production and can reduce the manufacturing cost. Similarly, the rider 30 may be integrally formed by casting as one piece.

The mounting method of the saddle anchorage 1 according to the present invention will be described with the reference to FIGS. 5 to 9. FIG. 5 is a sectional view showing the mounted anchorage according to the present invention.

Figure 6:
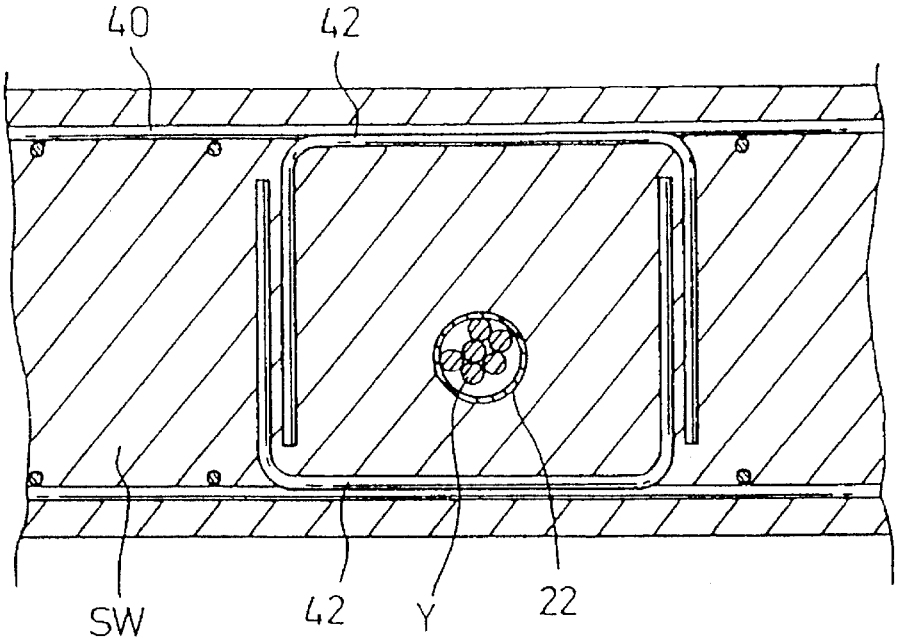
FIG. 6 is a sectional view along the line VI—VI of FIG. 5.

After the reinforcing cage 40 of the web SW of the prestressed concrete structure is completed, a reinforcement part which interferes with the location at which the saddle 10 is to be mounted is dismantled to provide a suitable space. The saddle 10 of the anchorage 1 according to the present invention is then mounted into the suitable space and fixed onto the reinforcing cage 40 of the web SW by welding or tying with iron wires. Next, a plurality of straight reinforcing steel bars 41 are provided in the transverse direction adjacent to the sleeve 21, the first rib plate 16, the second rib plate 17, and the third rib plate 18 at the underside of the saddle 10. Additionally, a plurality of sets of reinforcing steel bars 42 are provided on part of the reinforcing cage 40 behind the rear end side (left-hand side in FIG. 5) of the saddle 10, and fixed to the reinforcing cage 40 of the web SW by welding or tying with iron wires. As shown in FIG. 6, each set of the reinforcing steel bars 42 consists of two U-shaped steel bars connected with each other in opposite directions. The reinforcing steel bars 42 serve as a spring to alleviate the tensile stress of the web SW. Next, a formwork (not shown) is constructed around the reinforcing cage 40 of the web SW and then concrete is cast. After the concrete is cured and the formwork of the web SW is removed, post-tensioning strands Y are inserted through the first opening 19 and the sleeve 21 of the saddle 10 into the sheath 22 which is buried in advance in the interior of the web SW. The triangular conical rider 30 is then mounted onto the saddle 10 such that the third and fourth locking portions 35 and 36 of the rider 30 engage with the first and second locking portions 13 and 14 of the saddle 10, respectively, and the lower edge **34*a* of the front plate 34 of the rider 30 bears against the front edge of the saddle 10 (see FIG. 9). Finally, an anchor head 50 is fixed in the second opening 37 of the front plate 34 of the rider 30** and the steel strands Y can be tensioned.

With the saddle anchorage 1 consisting of the saddle 10 and the rider 30 according to the present invention, the saddle 10 can be readily mounted onto the reinforcing cage 40 of the web SW (or the slab) of the prestressed concrete structure, and after the concrete is cast, the rib plates 16, 17, and 18 and the first and second reinforcing steel bars 23 and 24 provided under the saddle 10 serve to prevent the saddle 10 from sliding and as part of the reinforcing cage 40 of the web (or the slab) of the prestressed concrete structure, thereby increasing the strength and preventing the concrete construction from cracking. Furthermore, the rider 30 can be mounted onto the saddle 10 easily and readily through the engagement of the third and fourth locking portions 35 and 36 of the former and the first and second locking portions 13 and 14 of the latter, respectively, so that the saddle 10 and the rider 30 can be firmly connected as a complete anchorage 1.

While the present invention has been described above in detail in its preferred embodiment, it is to be understood that the present invention is not limited to the details of the illustrated embodiment, but may have various changes, modifications and improvements, which may occur to those skilled in the art, without departing from the spirit and the scope of the present invention.

What is claimed is:

1. A saddle anchorage (1) comprising a saddle (10) which includes:

a rectangular metal plate (11) as a main body, in which a first locking portion (13) and a second locking portion (14) are formed in parallel with each other on an exposed surface (12) of the front end side of said metal plate (11) along the longitudinal direction thereof with the portion of said metal plate (11) between said two locking portions cut away to form a hollow portion, a bottom portion (15), obtained by cutting a truncated hollow cone obliquely, integrally connected to the underside of said metal plate (11) to constitute the bottom of said hollow portion between said two locking portions, a first rib plate (16) integrally and obliquely connected to the underside of the front end of said metal plate (11), a second rib plate (17) integrally and obliquely connected to the underside of said bottom portion (15) at substantially the middle thereof, a third rib plate (18), provided with a first opening (19) extending through said bottom portion (15) for passing post-tensioning strands (Y), integrally and obliquely connected to the underside of said metal plate (11) at the rear end of said bottom portion (15) to constitute an end plate thereof, a hollow cylindrical sleeve (21), into which a sheath (22) for post-tensioning strands (Y) can be inserted, integrally connected to the back side of said third rib plate (18) with a hole of said sleeve (21) aligned to said first opening (19), a plurality of U-shaped first reinforcing steel bars (23) connected along two longitudinal sides of said metal plate (11) in such a manner that each of said first reinforcing steel bars (23) extends downwards obliquely from said metal plate (11) toward the front end thereof at a predetermined angle with respect to said metal plate (11), and a plurality of U-shaped second reinforcing steel bars (24) connected to a predetermined area on the underside of the rear end side of said metal plate (11) in such a manner that each of said second reinforcing steel bars (24) extends downwards from and substantially perpendicular to the underside of said metal plate (11); and a rider (30) in a form of a triangular conical hollow cap for fixing an anchor head, which includes:

a first and a second triangular side plates (31, 32) with a third and a fourth locking portions (35, 36) engageable respectively with said first and second locking portions (13, 14) of said saddle (10) formed on lower edges thereof respectively, a rectangular top plate (33), and a substantially square front plate (34) provided with a second opening (37) for fixing an anchor head (50) and having a lower edge (**34*a*) which can bear against the front end edge of said saddle (10), extending downwards beyond said third and fourth locking portions (35, 36**).

2. A saddle anchorage according to claim 1, wherein said first, second, third, and fourth locking portions (13, 14, 35, 36) are formed in a stepped or a serrated structure.

3. A saddle anchorage according to claim 1 or 2, wherein said metal plate (11), said first, second, and third rib plates (16, 17, 18), said bottom portion (15), and said sleeve (21) of said saddle (10) are integrally formed by casting as one piece, and said first reinforcing steel bars (23) and said second reinforcing steel bars (24) are connected to said metal plate (11) by welding.

4. A saddle anchorage according to claim 1 or 2, wherein said rider (30) is integrally formed by casting as one piece.

5. A saddle anchorage according to claim 1 or 2, wherein said predetermined angle between said first reinforcing steel bars (23) and said metal plate (11) is in the range from 40 to 50 degrees.

6. A method of mounting a saddle anchorage according to any one of claims 1, the method comprises the steps of:

after a reinforcing cage of a web of a prestressed concrete structure is completed, dismantling a part of the reinforcing cage which interferes with a location at which said saddle of the anchorage is to be mounted to provide a suitable space;

mounting said saddle of the anchorage into said suitable space in said web in such a manner that said saddle is fixed onto the reinforcing cage of said web by welding or tying with iron wires;

installing additional reinforcing steel bars for increasing strength;

constructing a formwork around the reinforcing cage of said web and casting concrete;

after the concrete is cured and the formwork of said web is removed, inserting post-tensioning strands through said first opening and said sleeve of said saddle into a sheath for strands which is buried in advance in the interior of said web;

mounting said rider of the anchorage onto said saddle in such a manner that said third and fourth locking portions of said rider engage with said first and second locking portions of said saddle respectively, and said lower edge of the front plate of said rider bears against the front edge of said saddle; and fixing an anchor head in said second opening of the front plate of said rider for post-tensioning.

* * * * *